US007107787B2

(12) United States Patent
Inaba

(10) Patent No.: US 7,107,787 B2
(45) Date of Patent: Sep. 19, 2006

(54) EVAPORATOR

(75) Inventor: Hiroyuki Inaba, Saitama (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 11/095,658

(22) Filed: Apr. 1, 2005

(65) Prior Publication Data

US 2005/0223739 A1 Oct. 13, 2005

(30) Foreign Application Priority Data

Apr. 2, 2004 (JP) ..... P2004-110286

(51) Int. Cl.
*F25B 39/04* (2006.01)
*F25B 39/02* (2006.01)
*F28D 7/06* (2006.01)

(52) U.S. Cl. ..... 62/515; 62/524; 62/509; 165/176

(58) Field of Classification Search ..... 62/515, 62/524, 509; 165/176
See application file for complete search history.

(56) References Cited

U.S. PATENT DOCUMENTS 5,918,664 A * 7/1999 Torigoe ..... 165/78
6,397,938 B1 * 6/2002 Nishishita ..... 165/153
6,470,703 B1 * 10/2002 Wada et al. ..... 62/509
6,698,509 B1 * 3/2004 Rong ..... 165/153
6,814,135 B1 * 11/2004 Narahara et al. ..... 165/153
2002/0079093 A1 * 6/2002 Rong ..... 165/153
2002/0184913 A1 * 12/2002 Palanchon ..... 62/515
2004/0206490 A1 10/2004 Katoh et al.

FOREIGN PATENT DOCUMENTS

DE 44 46 817 A1 7/1995
JP 06-074679 A 3/1994
JP 10-238896 A 9/1998
JP 2000-105091 A 4/2000
WO WO 02/103263 A1 12/2002

* cited by examiner

*Primary Examiner*—Cheryl Tyler
*Assistant Examiner*—B. Clayton McCraw
(74) *Attorney, Agent, or Firm*—Foley & Lardner LLP

(57) ABSTRACT

In an inlet heat exchange unit, wherein a refrigerant's dryness is low and its flow distribution is likely to cause deviation, a number of heat exchange passages in an ascending flow path at an upstream side is less than the number of heat exchange passages in descending flow paths. Accordingly, refrigerant flowing in the ascending flow path increases, and a region in which the refrigerant lacks is reduced, thereby decreasing temperature variations. In an outlet heat exchange unit, wherein the refrigerant's dryness is high and its flow distribution is unlikely to cause deviation, the number of heat exchange passages a most downstream path is greater than the number of heat exchange passages in the immediately preceding path, thereby suppressing an increase in flow resistance in the most downstream path and keeping flow resistance in the outlet heat exchange unit low.

7 Claims, 15 Drawing Sheets

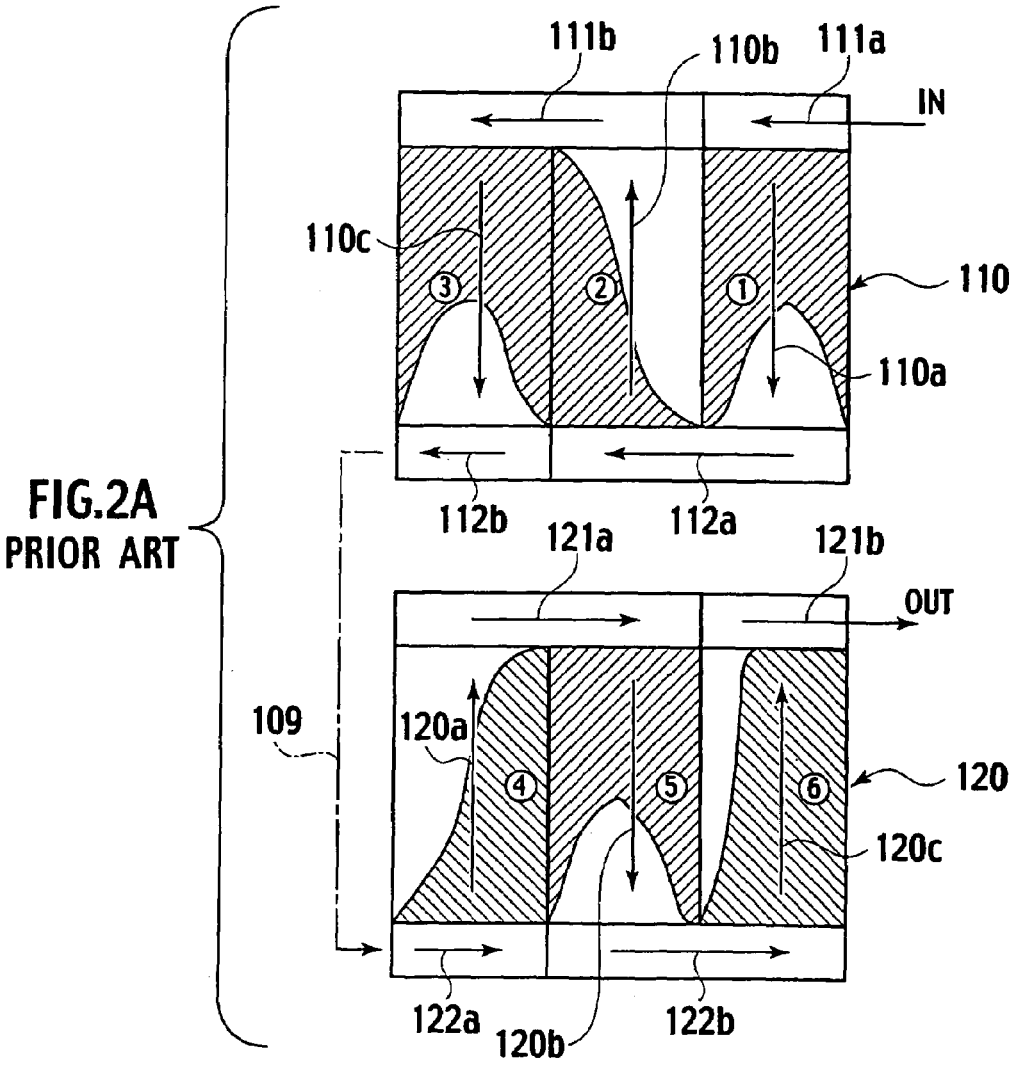
FIG.2A
PRIOR ART
FIG.2B
PRIOR ART
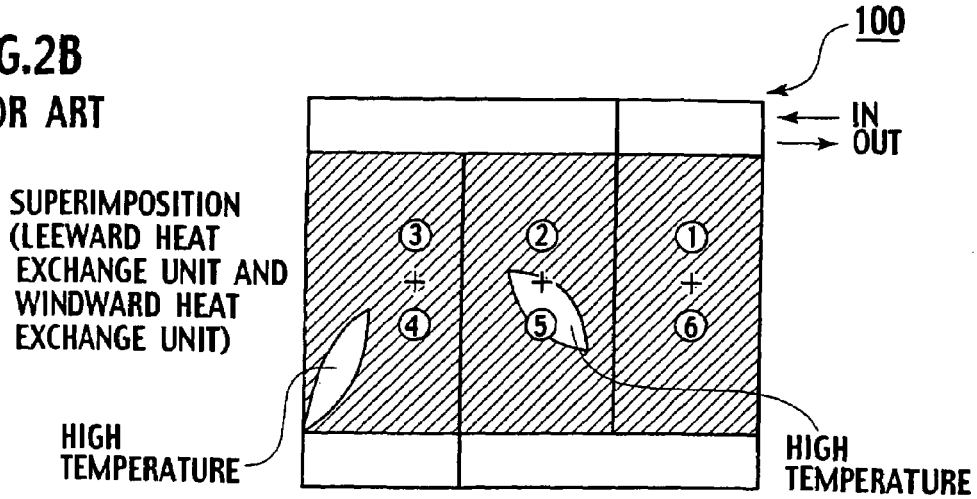

EVAPORATOR

BACKGROUND OF THE INVENTION

1. Field of the Invention

The present invention relates to an evaporator in which heat exchange units are arranged in parallel at the windward side and the leeward side.

2. Description of the Related Art

As disclosed in Japanese Patent Applications Laid-Open No. 6-74679, No. 10-238896 and No. 2000-105091, there has been conventionally proposed an evaporator in which heat exchange units are arranged in parallel at the windward side and the leeward side. FIG. 1 shows an example of this type of evaporator in which heat exchange units are arranged in parallel at the windward side and the leeward side. The evaporator 100 shown in FIG. 1 is configured so that a leeward heat exchange unit 110 comprised of an upper tank 111, a lower tank 112 and a plurality of heat exchange passages communicating the both tanks 111 and 112 and a windward heat exchange unit 120 comprised of an upper tank 121, a lower tank 122 and a plurality of heat exchange passages communicating the both tanks 121 and 122 are arranged so as to be superimposed in front and behind in the ventilating direction.

In leeward inlet heat exchange unit 110, an evaporator inlet 107 is provided at the right end of the upper tank 111, the upper tank 111 is divided into an upper first tank 111*a* and upper second tank 111*b* with a partition 114, the lower tank 112 is divided into a lower first tank 112*a* and a lower second tank 112*b* with a partition 1 15. Accordingly, the plurality of laminated heat exchange passages in multistage are divided into a first path 110*a*, a second path 110*b* and a third path 110*c* from right to left. A refrigerant introduced from the evaporator inlet 107 into the leeward heat exchange unit 110 flows from the upper first tank part 111*a*, the first path 110*a*, the lower first tank part 112*a*, the second path 110*b*, the upper second tank part 111*b*, the third path 110*c* to the lower second tank part 112*b* in this order. Then, the refrigerant is introduced from the lower second tank part 112*b* as a most downstream part of the leeward heat exchange unit 110 to the lower first tank part 122*a* as a most upstream part of the windward heat exchange unit 120 through a communicating path 109.

On the other hand, in the windward heat exchange unit 120, the lower tank 122 is divided into a lower first tank part 122*a* and a lower second tank part 122*b* with a partition 124, while the upper tank 121 is divided into an upper first tank part 121*a* and an upper second tank part 121*b* with a partition 125. The plurality of laminated heat exchange passages in multistage is divided into a first path 120*a*, a second path 120*b* and a third path 120*c* from left to right. The refrigerant introduced from communicating path 109 into the windward heat exchange unit 120 flows from the lower first tank part 122*a*, the first path 120*a*, the upper first tank part 121*a*, the second path 120*b*, the lower second tank part 122*b*, the third path 120*c* to the upper second tank part 121*b* in this order. Then, the refrigerant is derived from an evaporator output 108 provided at a right end of the upper second tank part 121*b* as a most downstream part of the windward heat exchange unit 120.

Each pair of paths which overlap one other at the windward side and the leeward side are superimposed to each other in the ventilating direction. In the pair of paths which overlap one another (110*a* and 120*c*), (110*b* and 120*b*), (110*c* and 120*a*), the refrigerant flows in a reverse direction to each other, including flow in the upstream and downstream tank parts. Circled numbers in the figure refer to the order by which the refrigerant flows in these paths.

FIG. 2A shows distribution of liquid refrigerant in each of the heat exchange units 110 and 120, and FIG. 2B shows distribution of the liquid refrigerant in whole of the evaporator in which the heat exchange units are superimposed. The distribution of the liquid refrigerant substantially corresponds to the distribution of temperature. As shown in FIG. 2B, in the evaporator 100 in which two heat exchange units are laminated in the air flow direction, since the two heat exchange units can be complemented in respect to heat exchange, variations in temperature distribution can be reduced, compared with an evaporator with one heat exchange unit.

However, variations in temperature distribution are essentially inevitable. The variations is due to that air cannot be cooled appropriately in the region where the liquid-phase refrigerant does not flow, that is, where only gas-phase refrigerant flows.

SUMMARY OF THE INVENTION

The present invention has been achieved with such points in mind.

It therefore is an object of the present invention to provide an evaporator in which heat exchange units are laminated in two layers in the air flow direction, thereby to further reduce variations in temperature distribution.

As a result of studies, the inventor found that in an ascending path (the path in which flowing refrigerant becomes ascending flow in this specification), since liquid refrigerant poured from the lower tank ascends in the ascending path when the gas/liquid-phases refrigerant (in a state where gas-phase refrigerant and liquid-phase refrigerant are mixed) is pushed into the lower tank at the downstream side in the tank longitudinal direction to reach a predetermined pressure, the liquid refrigerant becomes unbalanced toward at the downstream side in the tank longitudinal direction and lacks at the upstream side in the tank longitudinal direction. The inventor also found that the above-mentioned phenomenon emerges remarkably in the inlet heat exchange unit in which the refrigerant (gas/liquid-phases refrigerant) with low dryness (=high wetness) flows, while the above-mentioned phenomenon does not emerges remarkably in the outlet heat exchange unit in which the refrigerant (gas-phase refrigerant) with high dryness (=low wetness) flows and that flow resistance becomes problematic in the outlet heat exchange unit in which the refrigerant is expanded, especially in the most downstream path in which volume of the liquid refrigerant becomes largest.

FIG. 3 is a view explaining temperature distribution in the case where all chambers 130*a* to 130*f* are ascending flow paths. As shown in FIG. 3, it is found that dryness of the refrigerant is increased as the path is located at the upstream side, resulting in increase in flow rate of the refrigerant and reduction in variations in temperature distribution.

Thus, the inventor devised a technical concept that the amount of the liquid refrigerant at the upstream side in the tank longitudinal direction is increased and variations in temperature is reduced in the inlet heat exchange unit, by reducing the number of heat exchange passages in the ascending flow path and that increase in flow resistance is prevented in the outlet heat exchange unit by making the number of heat exchange passages in the most downstream path larger than the number of heat exchange passages in the path immediately before the most downstream path.

To achieve the object, and under the studies described above, according to a first aspect of the present invention, there is provided an evaporator comprising: heat exchange units having a plurality of heat exchange passages which extend in the vertical direction, are laminated in multistage in the horizontal direction and flows a refrigerant therein and tanks which are provided at both upper and lower ends of the plurality of heat exchange passages in multistage and join/distribute the refrigerant from the heat exchange passages in multistage, wherein; the heat exchange unit are arranged in two layers toward the air flow direction; the heat exchange units are connected thereto so as to flow the refrigerant to one of the heat exchange units and then flow the refrigerant to the other of the heat exchange units; the heat exchange unit at the inlet side of the refrigerant is set to have two or more paths; the heat exchange unit at the outlet side of the refrigerant is set to have two or more paths; in the inlet heat exchange unit, the number of heat exchange passages in a ascending path in which the refrigerant ascends is made smaller than the number of heat exchange passages in an descending path in which the refrigerant descends; and in the outlet heat exchange unit, the number of heat exchange passages in a most downstream path is made larger than the number of heat exchange passages in a path immediately before the most downstream path.

According to the invention as stated in the first aspect, in the inlet heat exchange unit, since the number of heat exchange passages in the ascending path is made smaller than the number of heat exchange passages in the descending path, variations in temperature distribution can be reduced. Further, in the outlet heat exchange unit, since the number of heat exchange passages in the most downstream path in which volume of the flowing refrigerant is expanded most is made larger than the number of heat exchange passages in the path immediately before the most downstream path, increase in flow resistance can be suppressed. Therefore, the evaporator with small variations in temperature distribution and low flow resistance can be realized.

According to a second aspect of the invention, it is characterized by that in the evaporator in the first aspect, both heat exchange units have the same number of paths and the refrigerant flows in the path at the windward side and the path at the leeward side which are opposed to each other in the inverted direction.

According to the invention as stated in the second aspect, in addition to effects of the invention as stated in the first aspect, compared with evaporators in which two heat exchange units each having a different number of paths, it is easier to predict or simulate and control the state where temperature distribution in the two heat exchange units are superimposed. The invention as stated in the first aspect includes the evaporator in which the two heat exchange units each having a different number of paths and especially as the evaporator in which the two heat exchange units each having a different number of paths, the evaporator as stated in the third aspect is preferable.

According to a third aspect of the invention, it is characterized by that in the evaporator in the first aspect, the number of paths in the outlet heat exchange unit is made smaller than the number of paths in the inlet heat exchange unit.

According to the invention as stated in the third aspect, in addition to effects of the invention as stated in the first aspect, since the number of paths in the inlet heat exchange unit is made smaller than the number of paths in the outlet heat exchange unit, total passage sectional area of each path (sum of passage sectional area of the heat exchange passages of the paths) becomes large in the outlet heat exchange unit. For this reason, the passage sectional area of each path becomes large, thereby to reduce flow resistance. As a result, the evaporator is preferable in the case where it is required to further reduce flow resistance of the outlet heat exchange unit.

According to a fourth aspect of the invention, it is characterized by that in the evaporator in any of the first to the third aspects, the outlet heat exchange unit is set to have three or more paths, and in the outlet heat exchange unit, the number of heat exchange passages is gradually increased toward the path at the downstream side.

According to the invention as stated in the fourth aspect, in addition to effects of the invention as stated in any of the first to the fourth aspects, since in the output heat exchange unit, the number of the heat exchange passages is increased as the path is located at the upstream side, that is, total passage sectional area of the paths is increased with expansion of volume of the refrigerant, flow resistance in the outlet heat exchange unit can be suppressed most.

According to a fifth aspect of the invention, it is characterized by that in the evaporator in any of the first to fourth aspects, the outlet heat exchange unit is set to have three or more paths, and in the outlet heat exchange unit, the number of heat exchange passages in the ascending path is made smaller than the number of heat exchange passages in the descending path except the most downstream path.

According to the invention as stated in the fifth aspect, in addition to effects of the invention as stated in any of the first to the third aspects, since the number of heat exchange passages in the ascending path is made smaller than the number of heat exchange passages in the descending path except the most downstream path, temperature distribution can be further improved (refer to the first aspect) also in the outlet heat exchange unit. This evaporator is preferable in the case where it is required to give priority to uniformity of temperature distribution rather than reduction in flow resistance in the outlet heat exchange unit.

According to a sixth aspect of the invention, it is characterized by that in the evaporator in any of the first to the fifth aspects, the inlet heat exchange unit is set to have three or more paths.

With the configuration combining the fifth aspect and the sixth aspect, in the outlet heat exchange unit, uniformity of temperature distribution can be further improved while flow resistance is substantially reduced.

According to the invention as stated in the sixth aspect, in addition to effects of the invention as stated in any of the first to the fifth aspects, since the inlet heat exchange unit is set to have three or more paths, variations in temperature distribution in the inlet heat exchange unit can be further reduced.

According to a seventh aspect of the invention, it is characterized by that in the evaporator in any of the first to the sixth aspects, the inlet heat exchange unit is disposed at the leeward side and the outlet heat exchange unit is disposed at the windward side.

According to the invention as stated in the seventh aspect, in addition to effects of the invention as stated in any of the first to the sixth aspects, since the inlet heat exchange unit is disposed at the leeward side and the outlet heat exchange unit is disposed at the windward side, it is possible that air is firstly cooled in the outlet heat exchange unit disposed at the windward side and then the cooled air is further cooled in the inlet heat exchange unit disposed at the leeward side in lower temperatures. That is, air can be cooled in the outlet heat exchange unit and the inlet heat exchange unit in a phased manner. Therefore, the heat exchange units at the windward side and at the leeward side can be efficiently used without waste and heat exchange efficiency can be further increased.

BRIEF DESCRIPTION OF THE ACCOMPANING DRAWINGS

FIGS. 2A and 2B are schematic views showing distribution of liquid refrigerant in the evaporator of FIG. 1.

DETAILED DESCRIPTION OF THE PREFERRED EMBODIMENTS

Figure 1:
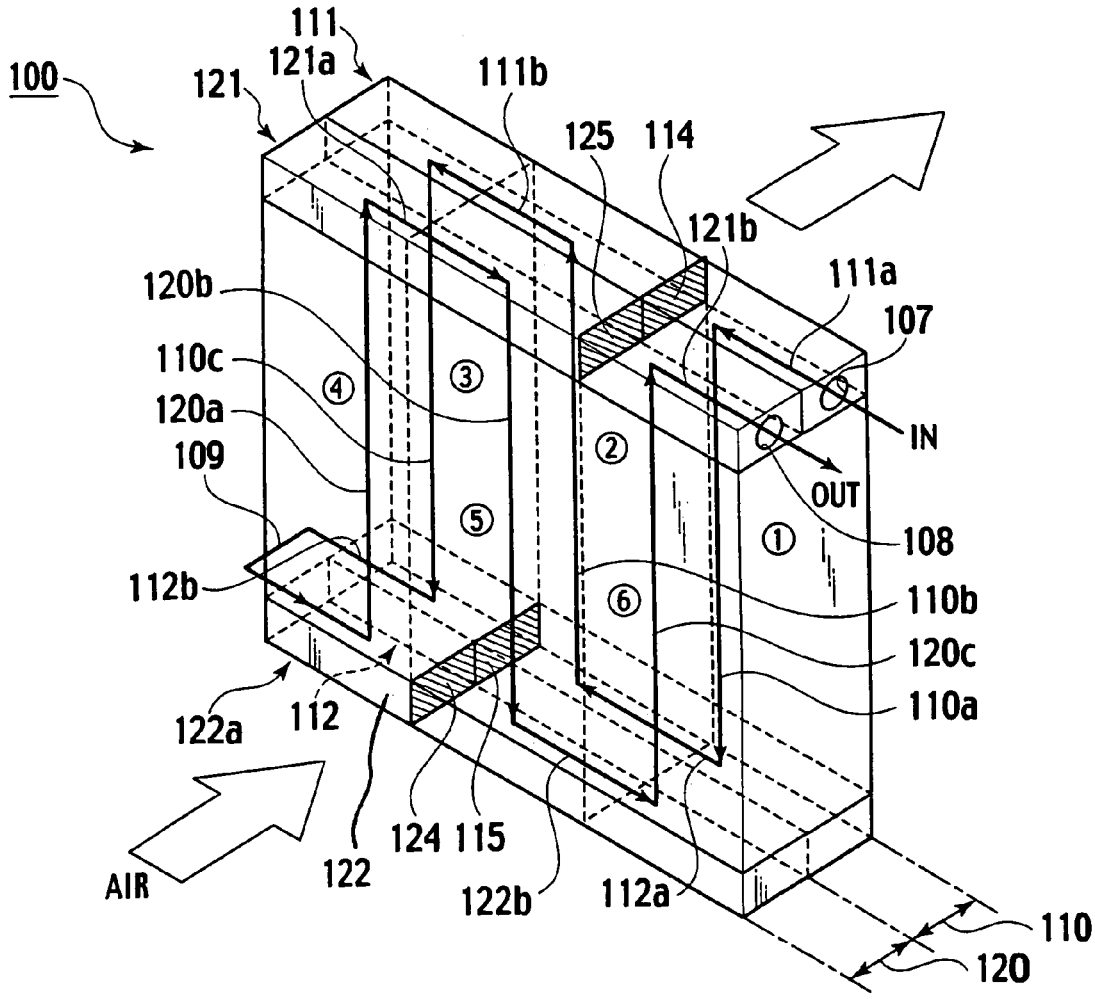
FIG.1 PRIOR ART
FIG. 1 is a schematic view showing an example of a conventional evaporator.
Figure 3:
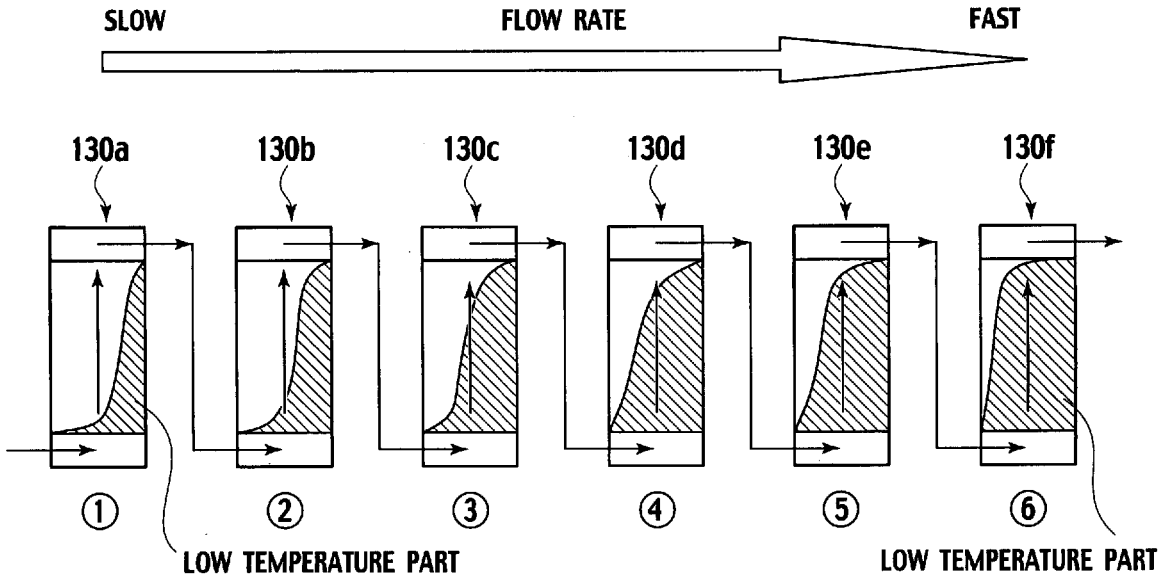
FIG. 3 is a schematic view showing temperature distribution in the case where all chambers are ascending flow paths.
Figure 4:
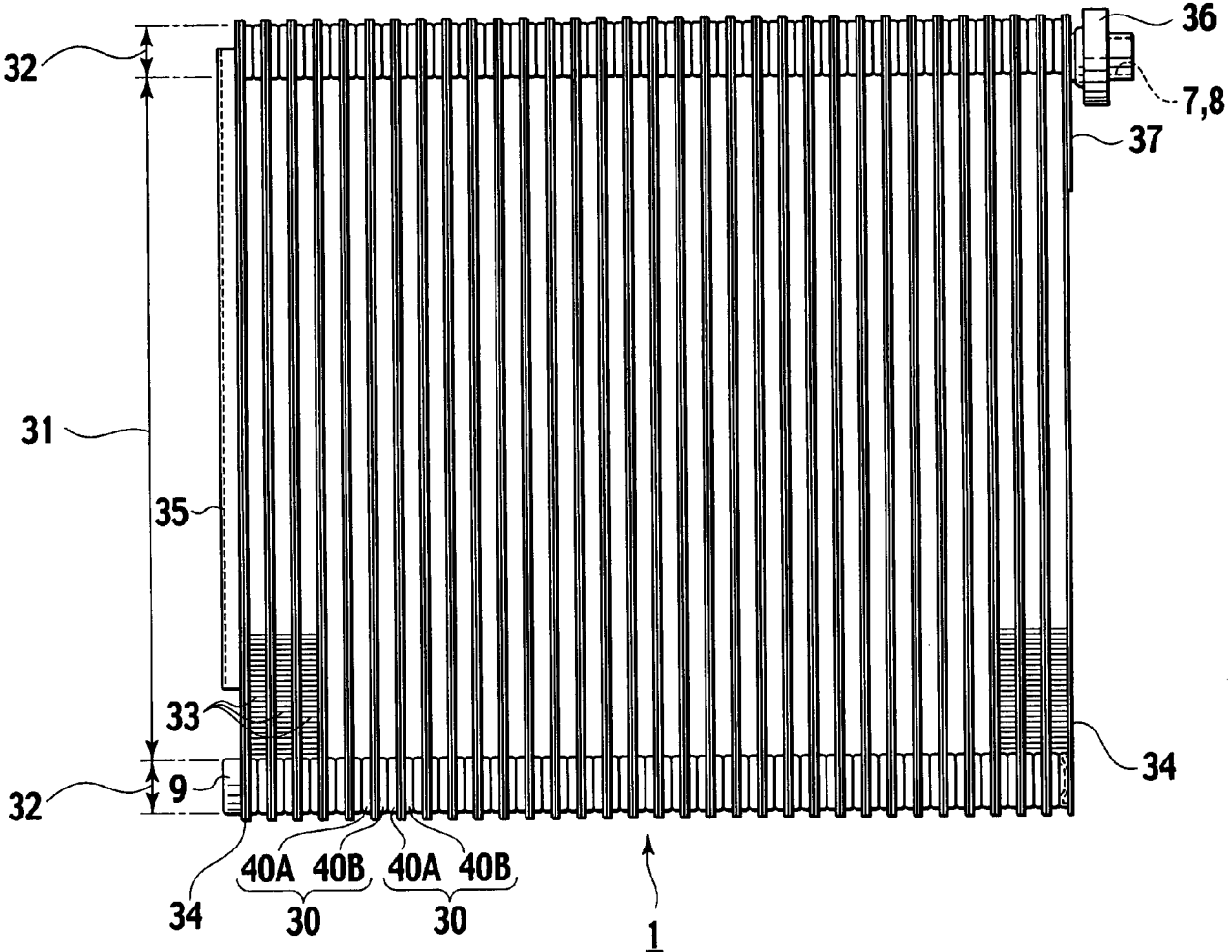
FIG. 4 is a front view of an evaporator according to the present invention for a first embodiment viewed from windward side.

There will be detailed below the preferred embodiments of the present invention with reference to the accompanying drawings. Like members are designated by like reference characters.

First embodiment: FIGS. 4 to 9 are views showing an evaporator in accordance with a first embodiment of the present invention.

The evaporator 1 in accordance with the first embodiment is an evaporator disposed in a refrigerating cycle of an automobile air-conditioning system. The evaporator 1 is installed in an air-conditioning case disposed inside an instrument panel and serves to exchange heat between a refrigerant flowing internally and an air passing in the outside, thereby to evaporate the refrigerant and cool the air. The evaporator of the present invention is not limited to automobile air-conditioning system and can be applied to other technical fields.

Figure 8:
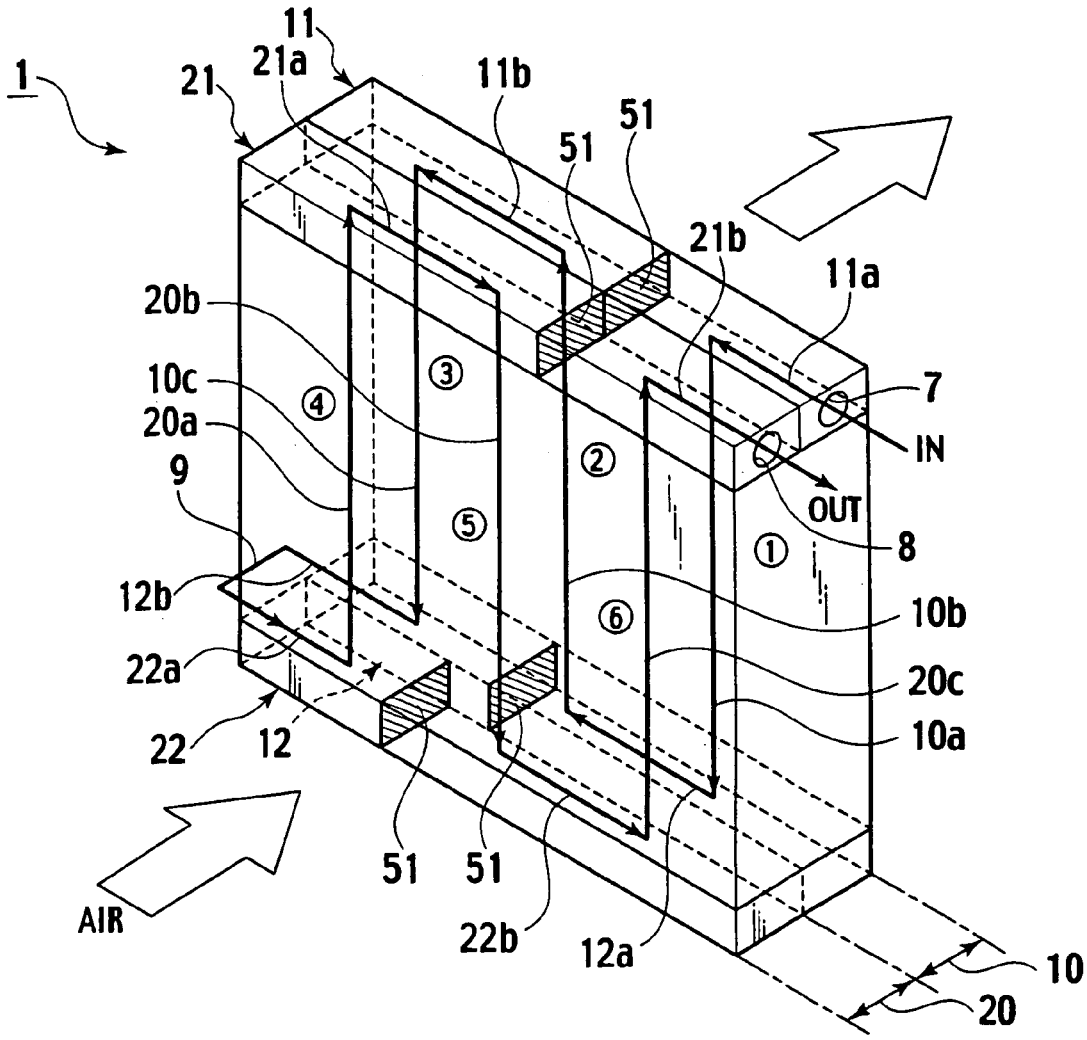
FIG. 8 is a schematic view showing refrigerant flow in the evaporator.

The whole configuration within the evaporator will be described with reference to FIG. 8.

In the evaporator 1, an inlet heat exchange unit 10 and an outlet heat exchange unit 20 for refrigerant are arranged in parallel at the windward side and the leeward side, respectively.

The inlet heat exchange unit 10 is comprised of an upper tank 11, a lower tank 12 and a plurality of heat exchange passages connected between these tanks 11 and 12. The outlet heat exchange unit 20 is comprised of an upper tank 21, a lower tank 22 and a plurality of heat exchange passages connected between these tanks 21 and 22.

In the inlet heat exchange unit 10, the upper tank 11 is divided into an upper first tank part 11*a* and an upper second tank part 11*b* with a partition 51, while the lower tank 12 is divided into a lower first tank part 12*a* and a lower second tank part 12*b* with a partition 51. An evaporator inlet 7 is provided at the right end of the upper tank 11 and the plurality of laminated heat exchange passages in multistage is divided into a first path 10*a*, a second path 10*b* and a third path 10*c* from right to left. Accordingly, a refrigerant introduced from the evaporator inlet 7 into the outlet heat exchange unit 20 flows from the upper first tank part 11*a*, the first path 10*a*, the lower first tank part 12*a*, the second path 10*b*, the upper second tank part 11*b*, the third path 10*c* to the lower second tank part 12*b* in this order. Then, the refrigerant is introduced from a most downstream part of the inlet heat exchange unit 10 (lower second tank part 12*b*) to a most upstream part of the outlet heat exchange unit 20 (lower first tank part 22*a*) through a communicating path 9.

On the other hand, in the outlet heat exchange unit 20, the lower tank 22 is divided into a lower first tank part 22*a* and a lower second tank part 22*b* with a partition 51, while the upper tank 21 is divided into an upper first tank part 21*a* and an upper second tank part 21*b* with a partition 51. An evaporator outlet 8 is provided at the right end of the upper tank 21. The plurality of laminated heat exchange passages in multistage is divided into a first path 20*a*, a second path 20*b* and a third path 20*c* from left to right. The refrigerant introduced from communicating path 9 into the outlet heat exchange unit 20 flows from the lower first tank part 22*a*, the first path 20*a*, the upper first tank part 21*a*, the second path 20*b*, the lower second tank part 22*b*, the third path 20*c* to the upper second tank part 21*b* in this order. Then, the refrigerant is derived from an evaporator output 8 provided at a right end of the upper second tank part 21*b* as a most downstream part of the windward heat exchange unit 20 (heat exchange unit in the downstream of refrigerant).

In the evaporator 1, each of the heat exchange units is divided into a plurality of paths (in this case, three paths) (10*a*, 10*b*, 10*c*, 20*a*, 20*b*, 20*c*) so as to make the number of windings equal to each other in both heat exchange units 10, 20. The refrigerant flows in a pair of paths which overlap one another at the windward side and the leeward side (for example, the first path 10*a* of the inlet heat exchange unit 10 and the third path 20*c* of the outlet heat exchange unit 20) in a reverse direction to each other, including flow in the upstream and downstream tank parts.

Next, a manufacturing process of the evaporator in accordance with the first embodiment is added. The evaporator 1 is manufactured as follows: A plurality of tubes 30 disposed in the vertical direction are laminated in multistage in the horizontal direction with an outer fin 33 being interposed therebetween and side plates 35, 37 for reinforcing strength and a pipe connector 36 and the like are formed at an outermost side in the tube-laminating direction (outermost side in the horizontal direction) to be formed in a predetermined evaporator's shape. Subsequently, these components are brazed together (Refer to FIGS. 4, 5 and 6). A reference numeral 34 in FIGS. 4 and 5 denotes a metal thin plate for an outermost end.

Figure 6:
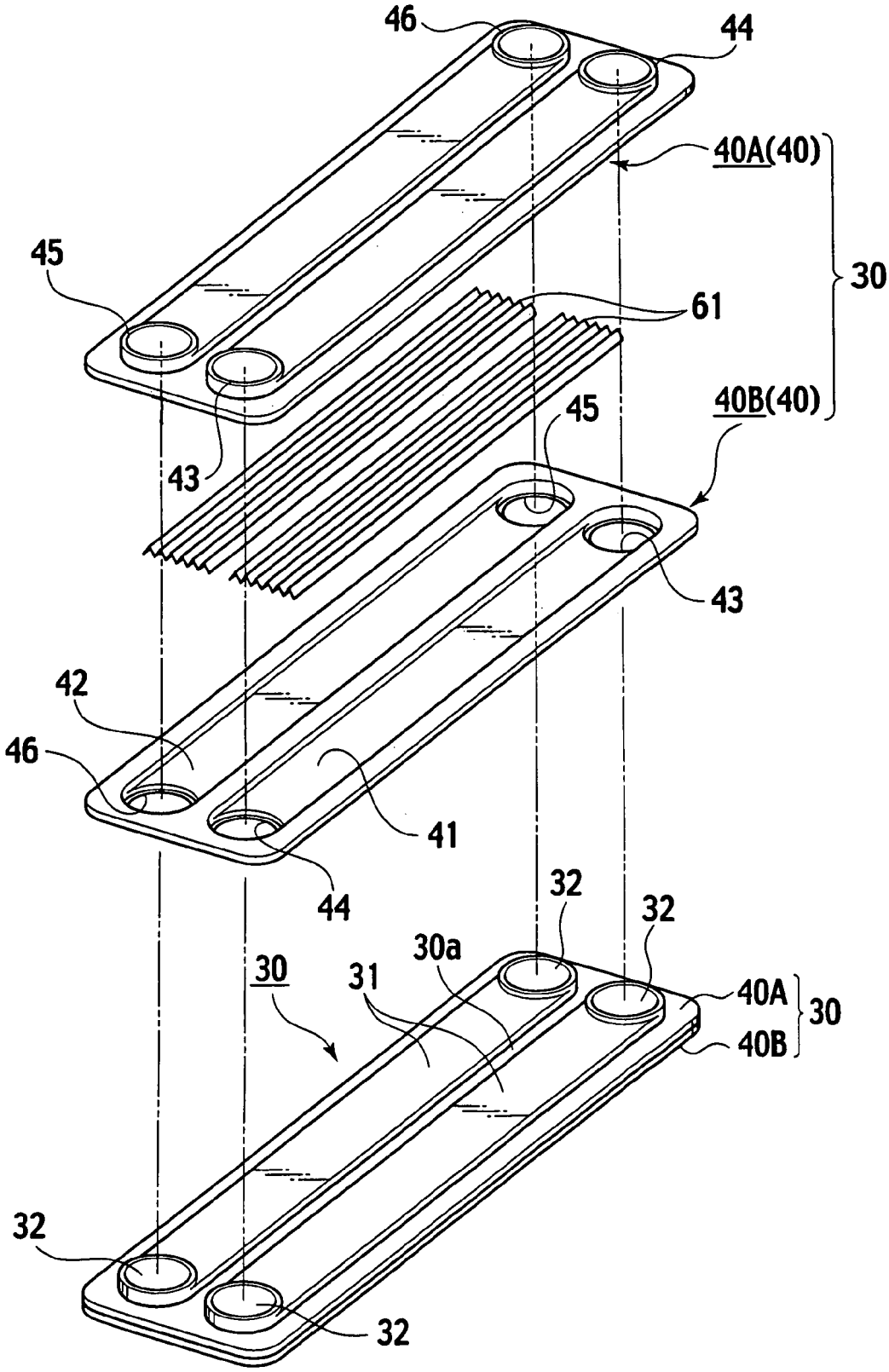
FIG. 6 is a perspective view showing configuration of a tube.

As shown in FIG. 6, the tube 30 is configured so that a pair of metal thin plates 40A and 40B are bonded to each other back to back with inner fins 61, 61 being sandwiched therebetween. In the tube 30, two heat change passages 31, 31 for flowing the refrigerant therein are formed across a partition 30*a* at the center of the paths, and at wall parts of the tube 30, tubular tank parts 32, 32 protruding outward from both ends of each heat exchange path 31 are formed. The metal thin plates 40A and 40B constituting the tube 30 each comprise two recesses for heat exchange passage 41, 42 and four tank parts 43, 44, 45, 46, which correspond to the two passages 31, 31 and four tank parts 32, 32 of the tube 30 respectively. The metal thin plates 40A and 40B have the same shape as each other. The metal thin plate 40A is turned over to become the metal thin plate 40B and the metal thin plate 40B is turned over to become the metal thin plate 40A.

Figure 7:
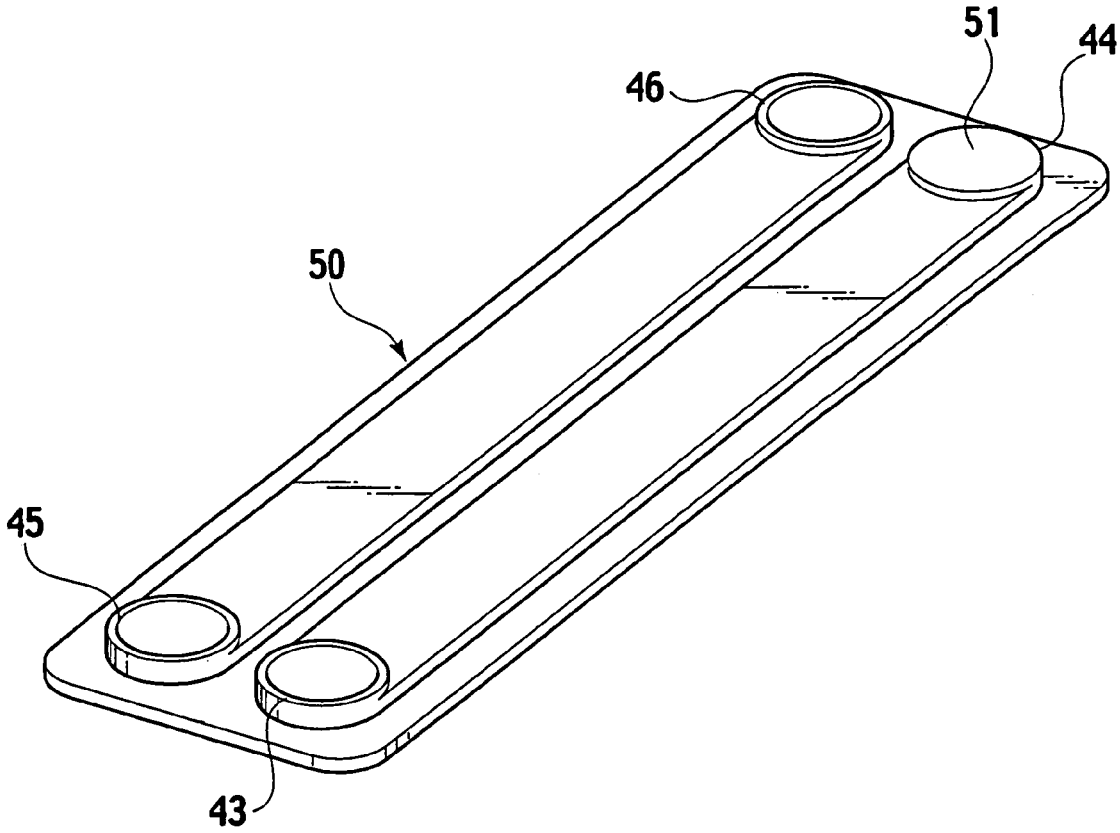
FIG. 7 is perspective view showing a metal thin plate having a blockage part for constituting a partition of a tank.

The partition 51 formed in each of the tanks 11, 12, 21, and 22 of the above-mentioned heat exchange units 10 and 20 is formed by using a metal thin plate 50 which comprises a blockage part for constituting the partition 51 as shown in FIG. 7 in place of the metal thin plates 40A, 40B at predetermined lamination positions.

Figure 5:
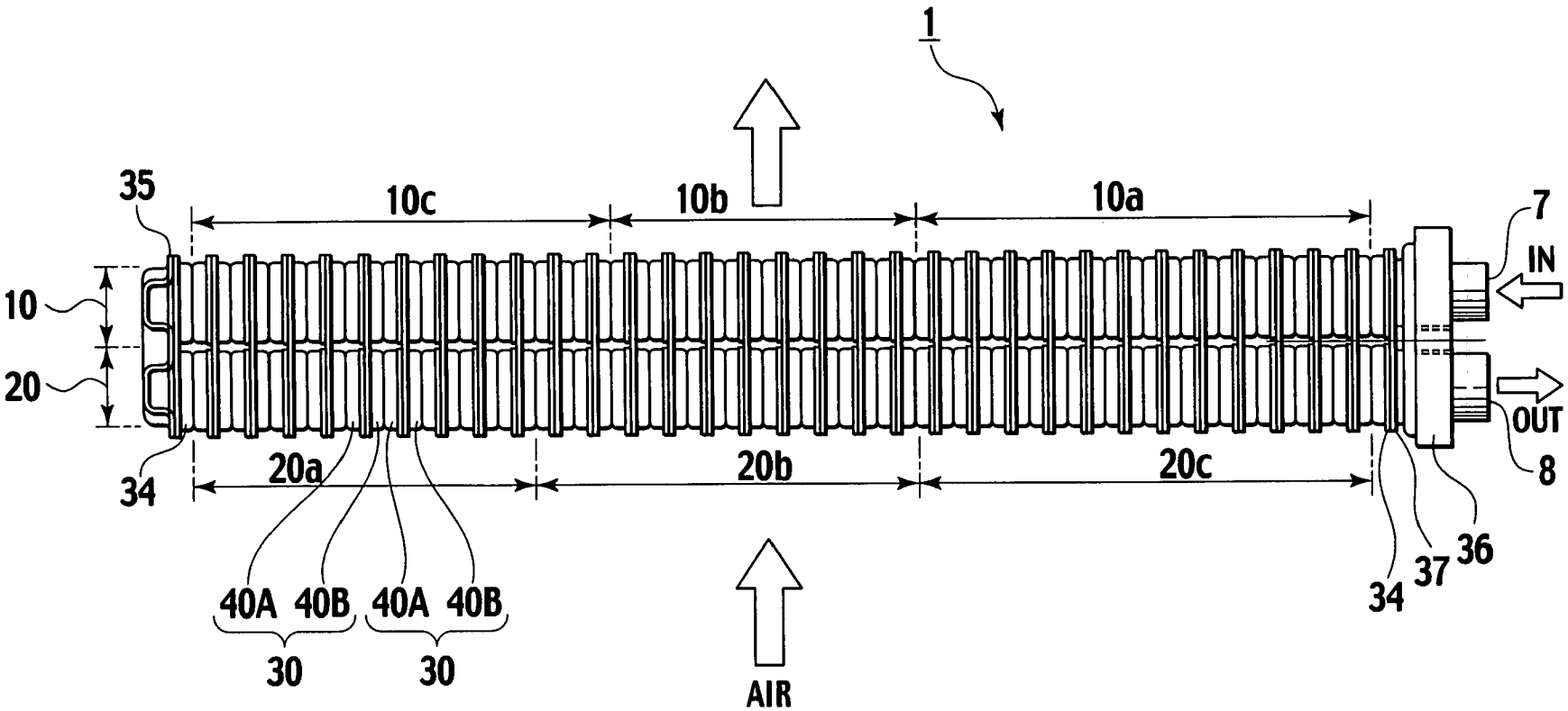
FIG. 5 is a top view of the evaporator.

Next, features of the first embodiment will be described with reference to FIGS. 5 and 9. The first embodiment is characterized by the division of path set by arrangement of the metal thin plate 50.

First, in the inlet heat exchange unit 10, the number of heat exchange passages in the second path 10*b* as an ascending flow path is made smaller than the number of heat exchange passages in the first path 10*a* and the third path 10*c* as descending flow paths. In other words, relationship between a total passage sectional area S10*b* of the ascending flow path 10*b* and total passage sectional areas S10*a*, S10*c* of the descending flow paths 10*a*, 10*c* is made to be S10*a*, S10*c*>S10*b* and relationship between a size L10*b* of the ascending flow path 10*b* in the tank longitudinal direction (horizontal direction) and a size L10*a*, L10*c* of the descending flow paths 10*a*, 10*c* in the tank longitudinal direction (horizontal direction) is made to be L10*a*, L10*c*>L10*b*. In this specification, the "total passage sectional area of path" refers to (the number of heat exchange passages of path)× (passage sectional area of heat exchange passages).

Figure 9A:
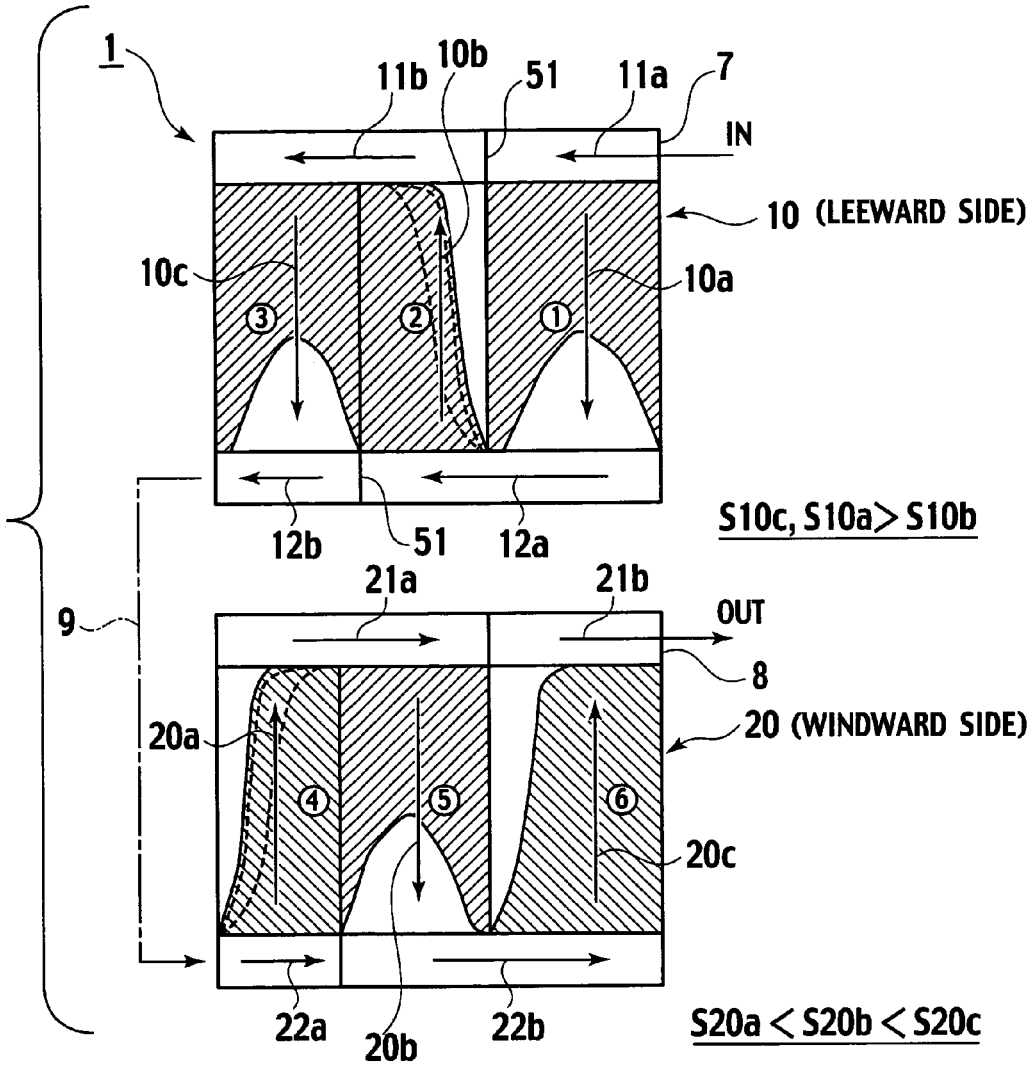
FIGS. 9A and 9B are schematic views showing distribution of liquid refrigerant in the evaporator.
Figure 9B:
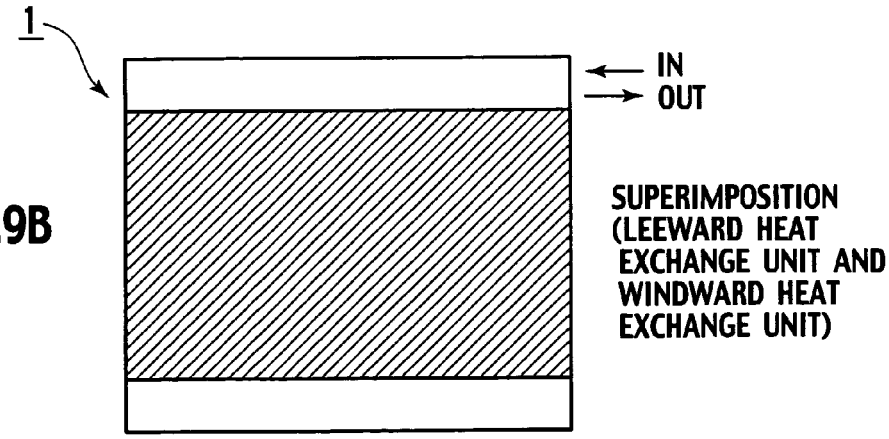

For this reason, in the inlet heat exchange unit 10 in which gas/liquid-phases refrigerant with low dryness (=high wetness) flows, as shown in FIG. 9A, since the amount of the liquid refrigerant in the ascending path 10*b* at the upstream side in the tank longitudinal direction (left side in FIG. 6) increases, the region where the liquid refrigerant in the ascending path 10*b* lacks is reduced. This decreases variations in temperature in the inlet heat exchange unit 10.

On the other hand, in the outlet heat exchange unit 20, the number of heat exchange passages in the path at the downstream side is made larger than the number of heat exchange passages in the path at the upstream side. In other words, relationship between a total passage sectional area S20*a* of the first path 20*a*, a total passage sectional area S20*b* of the second path 20*b* and a total passage sectional area S20*c* of the third path 20*c* is made to be S20*c*>S20*b*>S20*a* and relationship between a size L20*a* of the first path 20*a* in the tank longitudinal direction (horizontal direction), a size L20*b* of the second path 20*b* in the tank longitudinal direction (horizontal direction) and a size L20*c* of the third path 20*c* in the tank longitudinal direction (horizontal direction) is made to be L20*c* >L20*b* >L20*a*.

For this reason, in the outlet heat exchange unit 20 in which gas/liquid-phases refrigerant or gas-phase refrigerant expanded in volume with high dryness (=low wetness) flows, flow resistance in the third path 20*c* as the most downstream path, which is affected by flow resistance, is reduced, thereby to reduce passage resistance in the outlet heat exchange unit 20.

In this embodiment, except for the most downstream path 20*c*, the number of heat exchange passages in the ascending flow path 20*a* is made smaller than the number of heat exchange passages in the descending flow path 20*b*. Accordingly, except for the third path 20*c* as the most downstream path, the total passage sectional area S20*a* of the first path 20*a* as the ascending flow path becomes smaller than the total passage sectional area S20*b* of the second path 20*b* as the descending flow path. For this reason, the amount of the liquid refrigerant in the ascending path 20*a* at the upstream side in the tank longitudinal direction increases, and the region where the liquid refrigerant in the ascending path lacks is reduced. This further decreases variations in temperature in the outlet heat exchange unit 20. ((gas/liquid-phases refrigerant))

Next, effects of the evaporator 1 in accordance with the first embodiment will be described.

(I) According to this embodiment, in the inlet heat exchange unit 10 in which dryness of the refrigerant is low and flow distribution of the liquid refrigerant is liable to cause deviation, since the number of heat exchange passages in the ascending flow path 10*b* is made smaller than the number of heat exchange passages in the descending flow paths 10*a*, 10*c* (S10*a*, S10*c*>S10*b*), the liquid refrigerant flowing in the ascending flow path 10*b* at the upstream side in the tank longitudinal direction, in which the liquid refrigerant tends to lack, (dotted part in FIG. 9) increases, and the region where the liquid refrigerant lacks is reduced. This decreases variations in temperature in the outlet heat exchange unit 20.

In the outlet heat exchange unit 20 in which dryness of the refrigerant (gas/liquid-phases refrigerant or gas-phase refrigerant) is high and flow distribution of the refrigerant (gas/liquid-phases refrigerant or gas-phase refrigerant) is not liable to cause deviation, since the number of heat exchange passages in the most downstream path 20*c* in which volume of the flowing refrigerant is expanded most is made larger than the number of heat exchange passages in the path 20*b* immediately before the most downstream path (S20*c*>S20*b*), increase in flow resistance in the most downstream path 20*c* is suppressed, thereby that flow resistance in the outlet heat exchange unit 20 can be kept low.

As a result, an evaporator having small variations in temperature and low flow resistance can be realized.

(II) Especially according to the first embodiment, it is configured so that the outlet heat exchange unit 20 has three or more paths and the number of heat exchange passages in the downstream path in which volume of the refrigerant is expanded is made larger than the number of heat exchange passages in the upstream path, that is, S20*c*>S20*b* >S20*a*. This configuration is the most appropriate to reduce passage resistance in the outlet heat exchange unit 20.

(III) According to the first embodiment, it is configured so that both of the heat exchange units 10 and 20 have the same number of paths (three in this case) and the refrigerant flows in pair of opposing paths in the ventilating direction (10*a* and 20*c*), (10*b* and 20*b*) and (10*c* and 20*a*) in a reverse direction to each other. Therefore, compared with evaporators in which two heat exchange units 10, 20 each having a different number of paths (for example, an evaporator 400 in a fourth embodiment or an evaporator 700 in a seventh embodiment), it is easier to predict or simulate and control the state where temperature distribution in the two heat exchange units 10 and 20 are superimposed.

(IV) According to the first embodiment, it is configured so that in the output heat exchange unit 20, except for the most downstream path 20*c*, the number of heat exchange passages in the ascending flow path 20*a* is made smaller than the number of heat exchange passages in the descending flow path 20*b*, that is, S20*b*>S20*a*. Therefore, also in the output heat exchange unit 20, further improvement in temperature distribution can be achieved.

(V) According to the first embodiment, since it is configured so that the inlet heat exchange unit 10 has three or more paths, compared with the configuration with two or less paths (for example, a second embodiment and a third embodiment), the total passage sectional areas S10*a*, S10*b*, S10*c* of the paths 10*a*, 10*b*, 10*c*, respectively, are reduced. Therefore, variations in temperature distribution in the inlet heat exchange unit 10 can be further reduced.

(VI) According to the first embodiment, since the inlet heat exchange unit 10 is disposed at the leeward side and the outlet heat exchange unit 20 is disposed at the windward side, air is firstly cooled in the outlet heat exchange unit 20 disposed at the windward side and then the cooled air is further cooled in the inlet heat exchange unit 10 disposed at the leeward side in lower temperatures. That is, air can be cooled in the outlet heat exchange unit 20 and the inlet heat exchange unit 10 in a phased manner. Therefore, the outlet heat exchange unit 20 at the windward side and the inlet heat exchange unit 10 at the leeward side can be efficiently used without waste and heat exchange efficiency can be further increased.

Other embodiments of the present invention will be described below. Figures showing detailed parts in the below-mentioned embodiments are not shown and the same or similar elements as in the first embodiment are indicated by same reference numerals and description thereof is not repeated.

Figure 10:
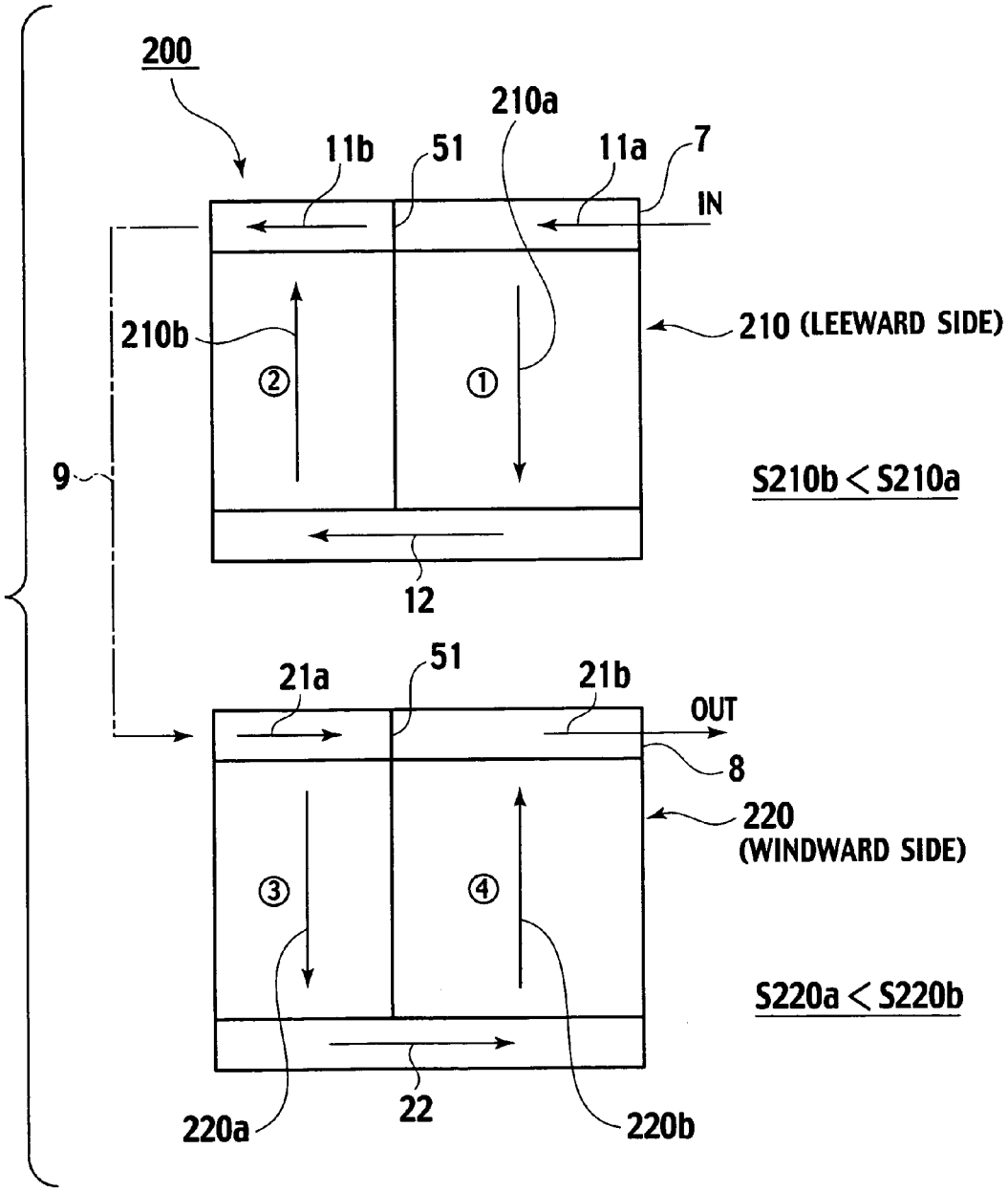
FIG. 10 is a schematic view showing an evaporator in accordance with a second embodiment.

Second embodiment: FIG. 10 shows an evaporator in accordance with a second embodiment.

An evaporator 200 in accordance with the second embodiment is different from the evaporator 1 of the first embodiment in that an inlet heat exchange unit 210 has two paths and an outlet heat exchange unit 220 has two paths while the inlet heat exchange unit 10 has three paths and the outlet heat exchange unit 20 has three paths.

The second embodiment has the following configuration, the same effects as those in the first embodiment (I), (III) and (VI) except (II), (IV) and (V) can be obtained.

(I) As in the first embodiment, the evaporator 200 in the second embodiment is configured so that in the inlet heat exchange unit 210, the number of heat exchange passages in a second path (ascending flow path) 210*b* is made smaller than the number of heat exchange passages in a first path (descending flow path) 210*a* (S210*b*<S210*a*), and in the outlet heat exchange unit 220, the number of heat exchange passages in a second path (most downstream path) 220*b* is made larger than the number of heat exchange passages in a first path (immediately before the most downstream path) 220*a* (S220*a*<S220*b*). For this reason, in the inlet heat exchange unit 210, a liquid refrigerant flowing in the ascending flow path 210*b* at the upstream side in the tank longitudinal direction, in which the liquid refrigerant tends to lack, increases, and the region where the liquid refrigerant lacks is reduced. This decreases variations in temperature. In the outlet heat exchange unit 220, increase in flow resistance in the most downstream path 220*b* is suppressed, thereby that flow resistance in the outlet heat exchange unit 220 can be kept low. Therefore, the evaporator with small variations in temperature and low flow resistance can be realized.

(III) In the second embodiment as in the first embodiment, it is configured so that both of the heat exchange units 210 and 220 have the same number of paths (two in this case) and the refrigerant flows in pairs of opposing paths in the ventilating direction (210*a* and 220*b*), (210*b* and 220*a*) in a reverse direction to each other. Therefore, compared with evaporators in which two heat exchange units 210, 220 each having a different number of paths (for example, an evaporator 400 in a fourth embodiment or an evaporator 700 in a seventh embodiment), it is easier to predict or simulate and control the state where temperature distribution in the two heat exchange units 210 and 220 are superimposed.

(VI) In the second embodiment as in the first embodiment, it is configured so that the inlet heat exchange unit 210 is disposed at the leeward side and the outlet heat exchange unit 220 is disposed at the windward side. Accordingly, firstly, air is cooled in the outlet heat exchange unit 220 disposed at the windward side and then the cooled air is further cooled in the inlet heat exchange unit 210 disposed at the leeward side in lower temperatures. That is, air can be cooled in the outlet heat exchange unit 220 and the inlet heat exchange unit 210 in a phased manner. Therefore, the outlet heat exchange unit 220 at the windward side and the inlet heat exchange unit 210 at the leeward side can be efficiently used without waste and heat exchange efficiency can be further increased.

Figure 11:
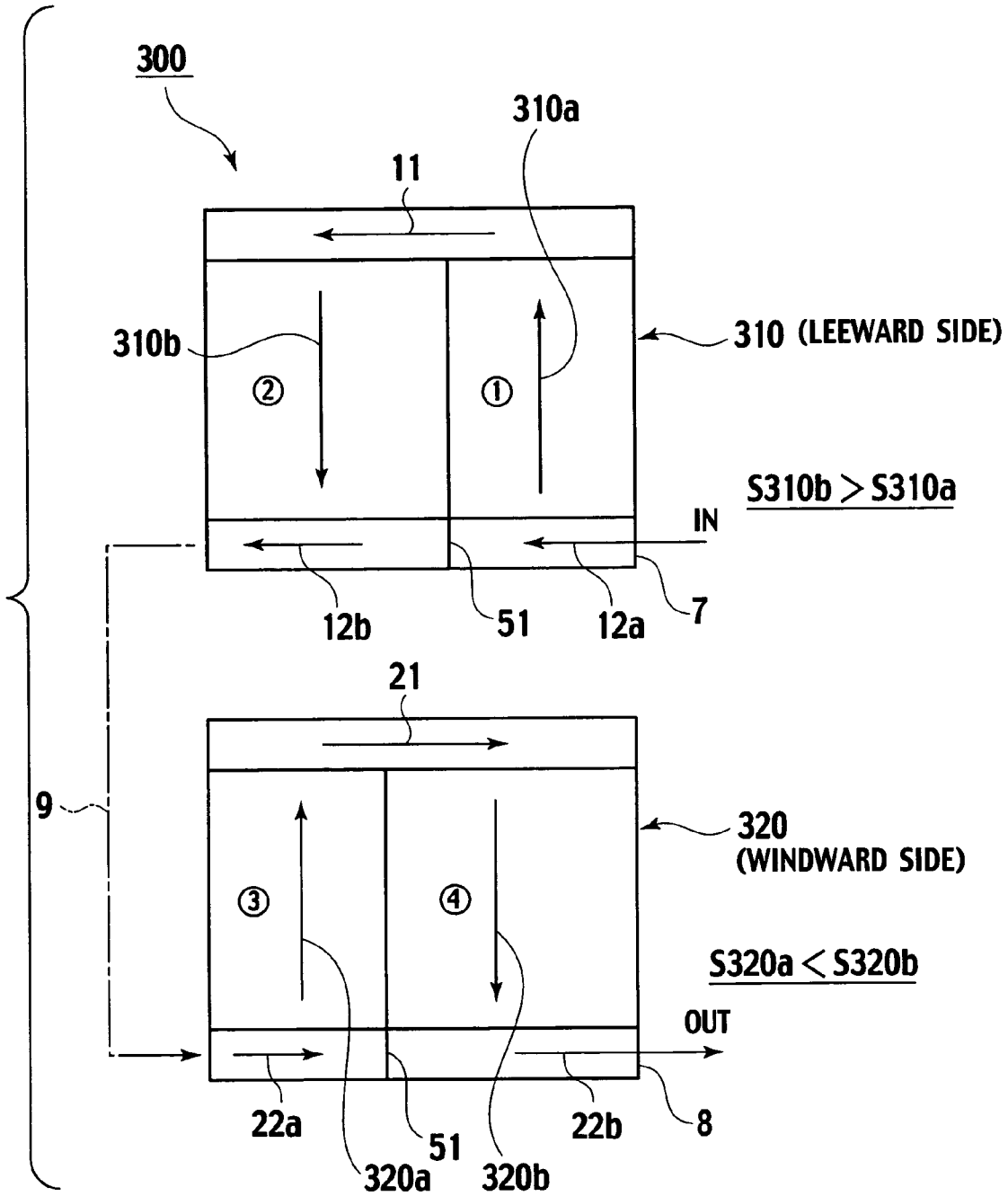
FIG. 11 is a schematic view showing an evaporator in accordance with a third embodiment.

Third embodiment: FIG. 11 shows a third embodiment of the present invention.

An evaporator 300 in accordance with the third embodiment is same as the evaporator 200 of the second embodiment except that the refrigerant flows in the inverted direction. As described below, the same effects as those in the evaporator 200 of the second embodiment can be obtained.

(I) As in the first embodiment, the evaporator 300 in the third embodiment is configured so that in an inlet heat exchange unit 310, the number of heat exchange passages in a first path 310*a* as a ascending flow path is made smaller than the number of heat exchange passages in a second path 310*b* as an descending flow path (S310*a*<310*b*), and in an outlet heat exchange unit 320, the number of heat exchange passages in a second path 320*b* as a most downstream path is made larger than the number of heat exchange passages in a first path 320*a* as a path immediately before the most downstream path (S320*b*>S320*a*). For this reason, in the inlet heat exchange unit 310, a liquid refrigerant flowing in the ascending flow path 310*a* at the upstream side in the tank longitudinal direction, in which the liquid refrigerant tends to lack, increases, and the region where the liquid refrigerant lacks is reduced. This decreases variations in temperature. In the outlet heat exchange unit 320, increase in flow resistance in the most downstream path 320*b* is suppressed, thereby that flow resistance in the outlet heat exchange unit 320 can be kept low. Therefore, the evaporator with small variations in temperature and low flow resistance can be realized.

(III) The evaporator 300 in the third embodiment is configured so that both of the heat exchange units 310 and 320 have the same number of paths (two in this case) and the refrigerant flows in pairs of opposing paths in the ventilating direction (310*a* and 320*b*), (310*b* and 320*a*) in a reverse direction to each other. Therefore, compared with evaporators in which two heat exchange units 310, 320 each having a different number of paths (for example, an evaporator 400 in a fourth embodiment or an evaporator 700 in a seventh embodiment), it is easier to predict or simulate and control the state where temperature distribution in the two heat exchange units 310 and 320 are superimposed.

(VI) The evaporator 300 in the third embodiment is configured so that the inlet heat exchange unit 310 is disposed at the leeward side and the outlet heat exchange unit 320 is disposed at the windward side. Accordingly, firstly, air is cooled in the outlet heat exchange unit 320 disposed at the windward side and then the cooled air is further cooled in the inlet heat exchange unit 310 disposed at the leeward side in lower temperatures. That is, air can be cooled in the outlet heat exchange unit 320 and the inlet heat exchange unit 310 in a phased manner. Therefore, the outlet heat exchange unit 320 at the windward side and the inlet heat exchange unit 310 at the leeward side can be efficiently used without waste and heat exchange efficiency can be further increased.

Figure 12:
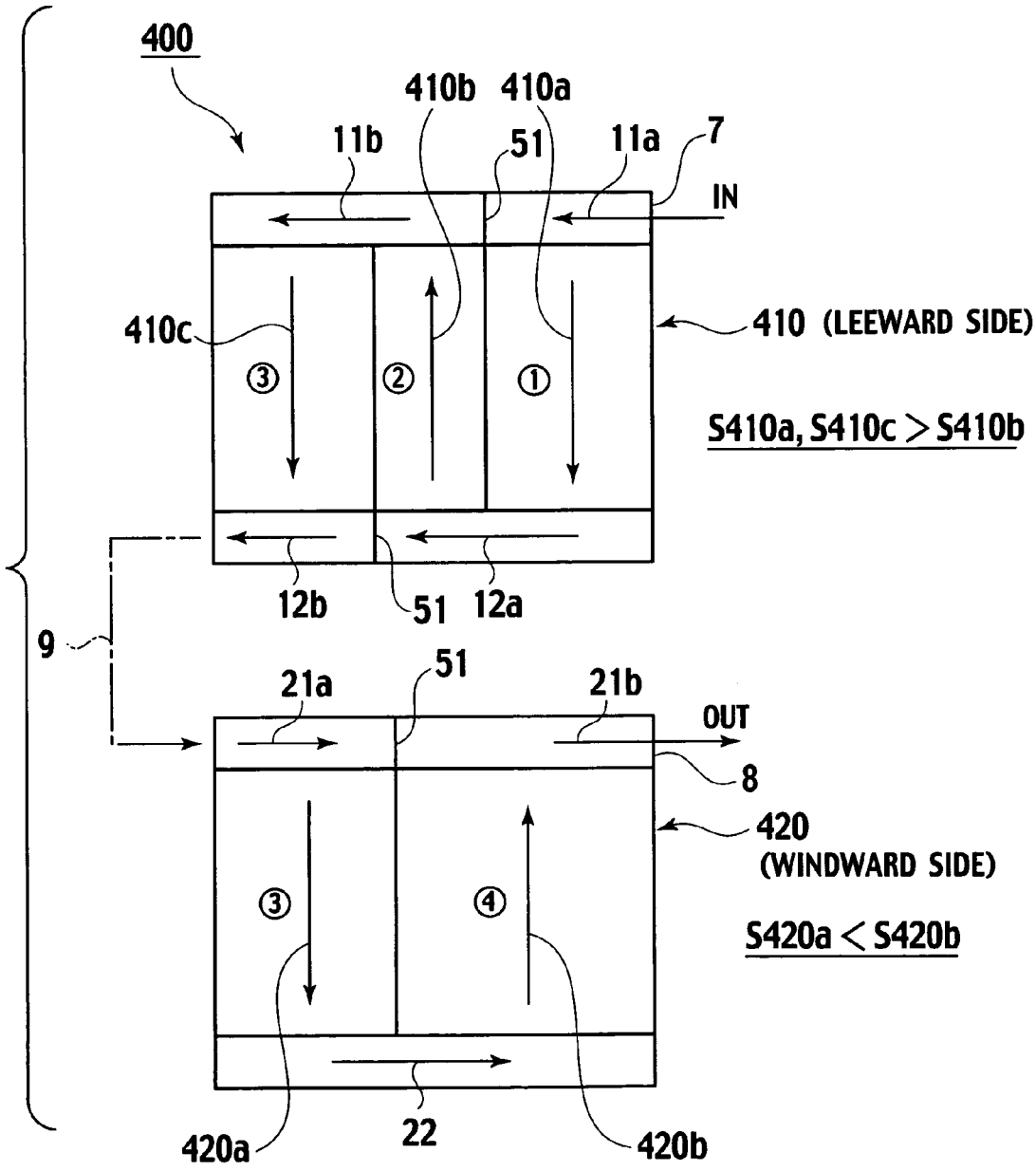
FIG. 12 is a schematic view showing an evaporator in accordance with a fourth embodiment.

Fourth embodiment:

FIG. 12 shows a fourth embodiment of the present invention.

An evaporator 400 in accordance with the fourth embodiment is different from the evaporator 1 of the first embodiment in that an outlet heat exchange unit 420 has two paths. The evaporator 400 in the fourth embodiment has the following configuration, the same effects as those in the first embodiment (I), (V), (VI) and (VII) except (II), (III) and (IV) can be obtained.

(I) According to the fourth embodiment, it is configured so that in an inlet heat exchange unit 410, the number of heat exchange passages in a second path 410*b* as an ascending flow path is made smaller than the number of heat exchange passages in a first path 410*a* and a third path 410*c* as descending flow paths (S410*a*, S410*c*>S410*b*), and in an outlet heat exchange unit 420, the number of heat exchange passages in a second path 420*b* as a most downstream path, in which volume of the flowing refrigerant is expanded most, is made larger than the number of heat exchange passages in a first path 420*a* as a path immediately before the most downstream path (S420*b*>S420*a*).

For this reason, in the inlet heat exchange unit 410 in which dryness of the refrigerant is low and flow distribution of the refrigerant is liable to cause deviation, a liquid refrigerant flowing in the ascending flow path 410*b* at the upstream side in the tank longitudinal direction, in which the liquid refrigerant tends to lack, increases, and the region where the liquid refrigerant lacks is reduced. This decreases variations in temperature. In the outlet heat exchange unit 420 in which dryness of the refrigerant is high and flow distribution of the refrigerant is not liable to cause deviation, increase in flow resistance in the most downstream path 420*b*, in which volume of the flowing refrigerant is expanded most, is suppressed, thereby that flow resistance in the outlet heat exchange unit 420 can be kept low.

Therefore, the evaporator with small variations in temperature and low flow resistance can be realized.

(V) According to the fourth embodiment, since it is configured so that the inlet heat exchange unit 410 has three or more paths, compared with the configuration with two or less paths (for example, the second embodiment and the third embodiment), the total passage sectional areas S410*a*, S410*b*, S410*c* of the paths 410*a*, 410*b*, 410*c*, respectively, are reduced. Therefore, variations in temperature distribution in the inlet heat exchange unit 410 can be further reduced.

(VI) According to the fourth embodiment, since the inlet heat exchange unit 410 is disposed at the leeward side and the outlet heat exchange unit 420 is disposed at the windward side, air is firstly cooled in the outlet heat exchange unit 420 disposed at the windward side and then the cooled air is further cooled in the inlet heat exchange unit 410 disposed at the leeward side in lower temperatures. That is, air can be cooled in the outlet heat exchange unit 420 and the inlet heat exchange unit 410 in a phased manner. Therefore, the outlet heat exchange unit 420 at the windward side and the inlet heat exchange unit 410 at the leeward side can be efficiently used without waste and heat exchange efficiency can be further increased.

(VII) The evaporator 400 in the fourth embodiment is configured so that the number of paths in the outlet heat exchange unit 420 (two in this case) is smaller than the number of paths in the inlet heat exchange unit 410 (three in this case). For this reason, in the outlet heat exchange unit 420, the total passage sectional areas S410*a* and S410*b* of the paths 410*a* and 410*b*, respectively, becomes larger. As a result, the evaporator is preferable in the case where it is required to further reduce flow resistance of the outlet heat exchange unit 420.

Figure 13:
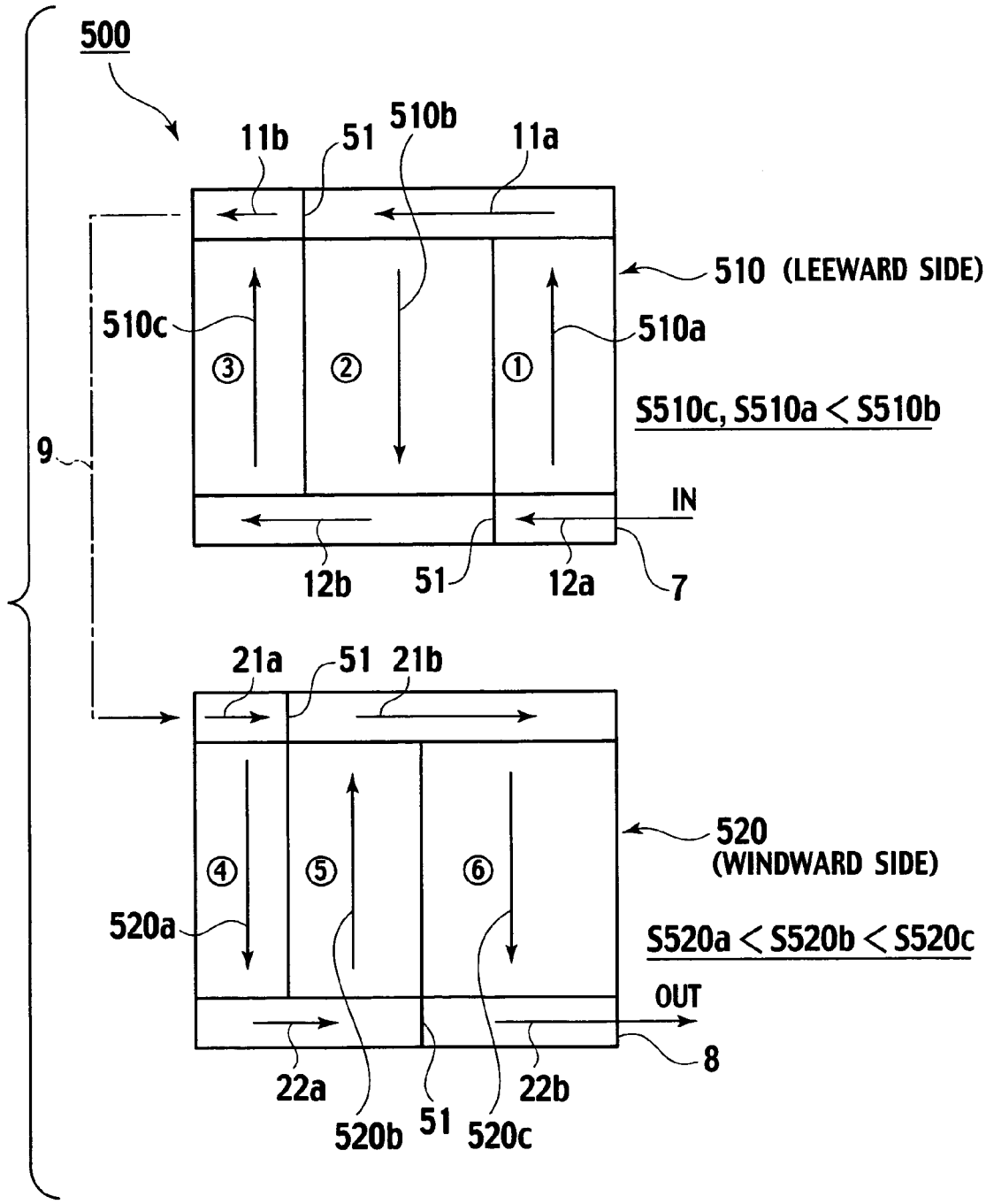
FIG. 13 is a schematic view showing an evaporator in accordance with a fifth embodiment.

Fifth embodiment: FIG. 13 shows a fifth embodiment of the present invention.

An evaporator 500 in accordance with the fifth embodiment is same as the evaporator 1 of the first embodiment except that the refrigerant flows in the inverted direction and in an outlet heat exchange unit 520, except for the most downstream path 520*c*, the number of heat exchange passages in an ascending flow path 520*b* is not larger than the number of heat exchange passages in a descending flow path 520*a*. The evaporator 500 in the fifth embodiment has the following configuration, the same effects as those in the first embodiment (I), (II), (III), (V) and (VI) except (IV) can be obtained.

(I) The evaporator 500 in the fifth embodiment is configured so that in an inlet heat exchange unit 510, the number of heat exchange passages in a first path 510*a* and a third path 510*c* as ascending flow paths is made smaller than the number of heat exchange passages in a second path 510*b* as a descending flow path (S510*a*, S510*c*<S510*b*), and in an outlet heat exchange unit 520, the number of heat exchange passages in a third path 520*c* as a most downstream path, in which volume of the flowing refrigerant is expanded most, is made larger than the number of heat exchange passages in a second path 520*b* as a path immediately before the most downstream path (S520*c*<S520*b*). For this reason, in the inlet heat exchange unit 510 in which dryness of the refrigerant is low and flow distribution of the refrigerant is liable to cause deviation, a liquid refrigerant flowing in the ascending flow paths 510*c*, 510*a* at the upstream side in the tank longitudinal direction, in which the liquid refrigerant tends to lack, increases, and the region where the liquid refrigerant lacks is reduced. This decreases variations in temperature. In the outlet heat exchange unit 520 in which dryness of the refrigerant is high and flow distribution of the refrigerant is not liable to cause deviation, increase in flow resistance in the most downstream path 520*c*, in which volume of the flowing refrigerant is expanded most, is suppressed, thereby that flow resistance in the outlet heat exchange unit 520 can be kept low. Therefore, the evaporator with small variations in temperature and low flow resistance can be realized.

(II) The evaporator 500 in accordance with the fifth embodiment is configured so that the outlet heat exchange unit 520 has three or more paths and the number of heat exchange passages in the downstream path in which volume of the refrigerant is expanded is made larger than the number of heat exchange passages in the upstream path (S520*c*>S520*b* >S520*a*).

This configuration is the most appropriate to reduce passage resistance in the outlet heat exchange unit 520.

(III) The evaporator 500 in the fifth embodiment is configured so that both of the heat exchange units 510 and 520 have the same number of paths (three in this case) and the refrigerant flows in pairs of opposing paths in the ventilating direction (510*a* and 520*c*), (510*b* and 520*b*), (510*c* and 520*a*) in a reverse direction to each other. Therefore, compared with evaporators in which two heat exchange units 510, 520 each having a different number of paths (for example, an evaporator 400 in the fourth embodiment or an evaporator 700 in a seventh embodiment), it is easier to predict or simulate and control the state where temperature distribution in the two heat exchange units 510 and 520 are superimposed.

(V) The evaporator 500 in the fifth embodiment is configured so that the inlet heat exchange unit 510 has three or more paths, compared with the configuration with two or less paths (for example, the second embodiment and the third embodiment), the total passage sectional areas S510*a*, S510*b*, S510*c* of the paths 510*a*, 510*b*, 510*c*, respectively, are reduced. Therefore, variations in temperature distribution in the inlet heat exchange unit 510 can be further reduced.

(VI) The evaporator 500 in the fifth embodiment is configured so that the inlet heat exchange unit 510 is disposed at the leeward side and the outlet heat exchange unit 520 is disposed at the windward side. For this reason, air is firstly cooled in the outlet heat exchange unit 520 disposed at the windward side and then the cooled air is further cooled in the inlet heat exchange unit 510 disposed at the leeward side in lower temperatures. That is, air can be cooled in the outlet heat exchange unit 520 and the inlet heat exchange unit 510 in a phased manner. Therefore, the outlet heat exchange unit 520 at the windward side and the inlet heat exchange unit 510 at the leeward side can be efficiently used without waste and heat exchange efficiency can be further increased.

Figure 14:
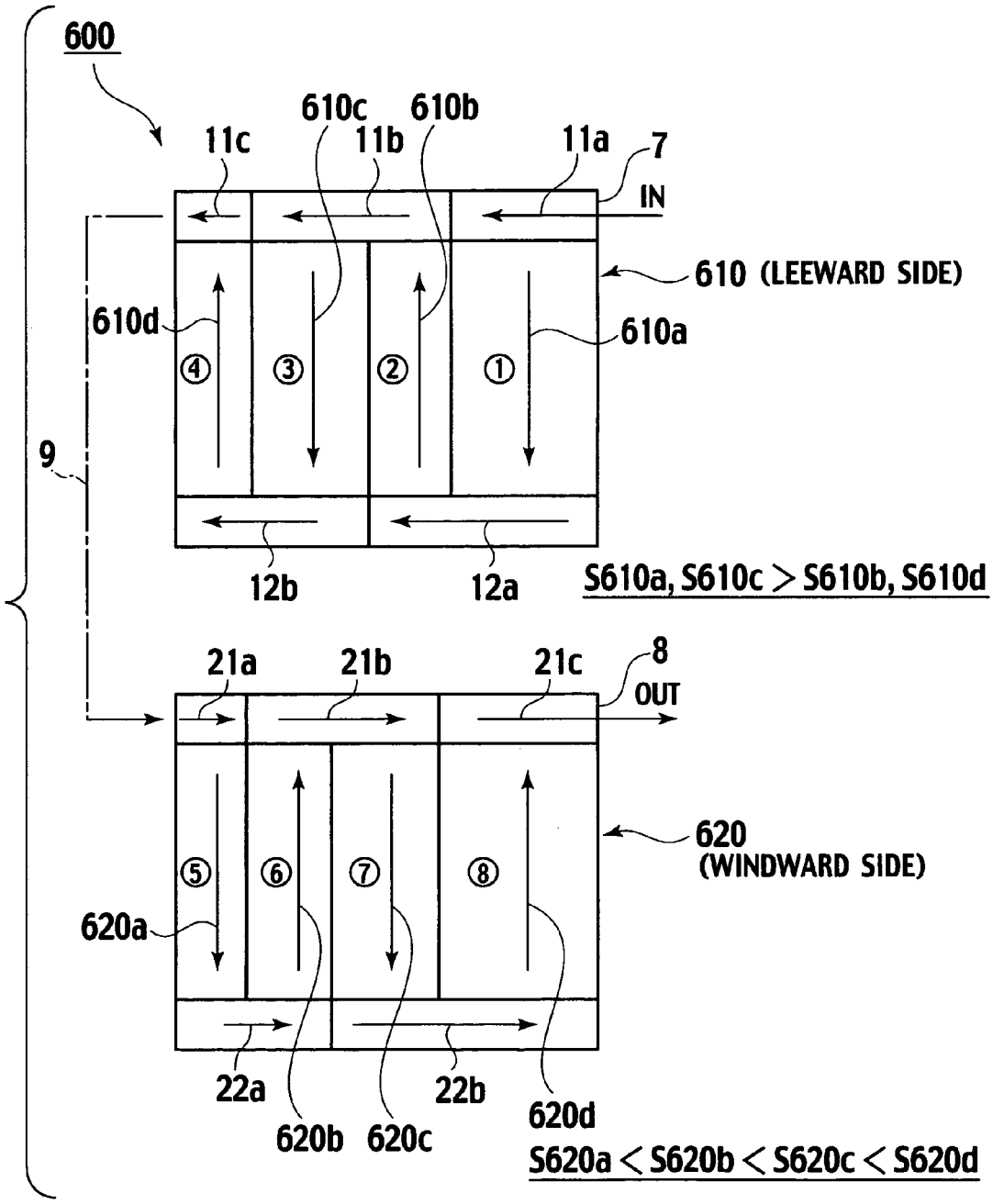
FIG. 14 is a schematic view showing an evaporator in accordance with a sixth embodiment.

Sixth embodiment: FIG. 14 shows a sixth embodiment of the present invention. An evaporator 600 in accordance with the sixth embodiment is same as the evaporator 1 of the first embodiment except that an inlet heat exchange unit 610 and an outlet heat exchange unit 620 each have four paths. The evaporator 600 in the sixth embodiment has the following configuration, the same effects as those in the first embodiment (I), (II), (III), (V) and (VI) except (IV) can be obtained.

(I) The evaporator 600 in the sixth embodiment is configured so that in an inlet heat exchange unit 610, the number of heat exchange passages in a second path 610*b* and a fourth path 610*d* as ascending flow paths is made smaller than the number of heat exchange passages in a first path 610*a* and a third path 610*c* as descending flow paths (S610*a*, S610*c*>S610*b*, S610*d*), and in an outlet heat exchange unit 620, the number of heat exchange passages in a fourth path 620*d* as a most downstream path, in which volume of the flowing refrigerant is expanded most, is made larger than the number of heat exchange passages in a third path 620*c* as a path immediately before the most downstream path (S620*d*>S620*c*). For this reason, in the inlet heat exchange unit 610 in which dryness of the refrigerant is low and flow distribution of the refrigerant is liable to cause deviation, a liquid refrigerant flowing in the ascending flow paths 610*b*, 610*d* at the upstream side in the tank longitudinal direction, in which the liquid refrigerant tends to lack, increases, and the region where the liquid refrigerant lacks is reduced. This decreases variations in temperature. In the outlet heat exchange unit 620 in which dryness of the refrigerant is high and flow distribution of the refrigerant is not liable to cause deviation, increase in flow resistance in the most downstream path 620*d*, in which volume of the flowing refrigerant is expanded most, is suppressed, thereby that flow resistance in the outlet heat exchange unit 620 can be kept low.

(II) The evaporator 600 in accordance with the sixth embodiment is configured so that the outlet heat exchange unit 620 has three or more paths and the number of heat exchange passages in the downstream path in which volume of the refrigerant is expanded is made larger than the number of heat exchange passages in the upstream path (S620*d*>S620*c*>S620*b*>S620*a*). This configuration is the most appropriate to reduce passage resistance in the outlet heat exchange unit 620.

(III) The evaporator 600 in the sixth embodiment is configured so that both of the heat exchange units 610 and 620 have the same number of paths (four in this case) and the refrigerant flows in pairs of opposing paths in the ventilating direction (610*a* and 620*d*), (610*b* and 620*c*), (610*c* and 620*b*), (610*d* and 620*a*) in a reverse direction to each other. Therefore, compared with evaporators in which two heat exchange units 610, 620 each having a different number of paths (for example, the evaporator 400 in the fourth embodiment or an evaporator 700 in a seventh embodiment), it is easier to predict or simulate and control the state where temperature distribution in the two heat exchange units 610 and 620 are superimposed.

(V) The evaporator 600 in the sixth embodiment is configured so that the inlet heat exchange unit 610 has three or more paths, compared with the configuration with two or less paths (for example, the second embodiment and the third embodiment), the total passage sectional areas S610*a*, S610*b*, S610*c* and S610*d* of the paths 610*a*, 610*b*, 610*c*, and 610*d*, respectively, are reduced. Therefore, variations in temperature distribution in the inlet heat exchange unit 610 can be further reduced.

(VI) The evaporator 600 in the sixth embodiment is configured so that the inlet heat exchange unit 610 is disposed at the leeward side and the outlet heat exchange unit 620 is disposed at the windward side. For this reason, air is firstly cooled in the outlet heat exchange unit 620 disposed at the windward side and then the cooled air is further cooled in the inlet heat exchange unit 610 disposed at the leeward side in lower temperatures. That is, air can be cooled in the outlet heat exchange unit 620 and the inlet heat exchange unit 610 in a phased manner. Therefore, the outlet heat exchange unit 620 at the windward side and the inlet heat exchange unit 610 at the leeward side can be efficiently used without waste and heat exchange efficiency can be further increased.

Figure 15:
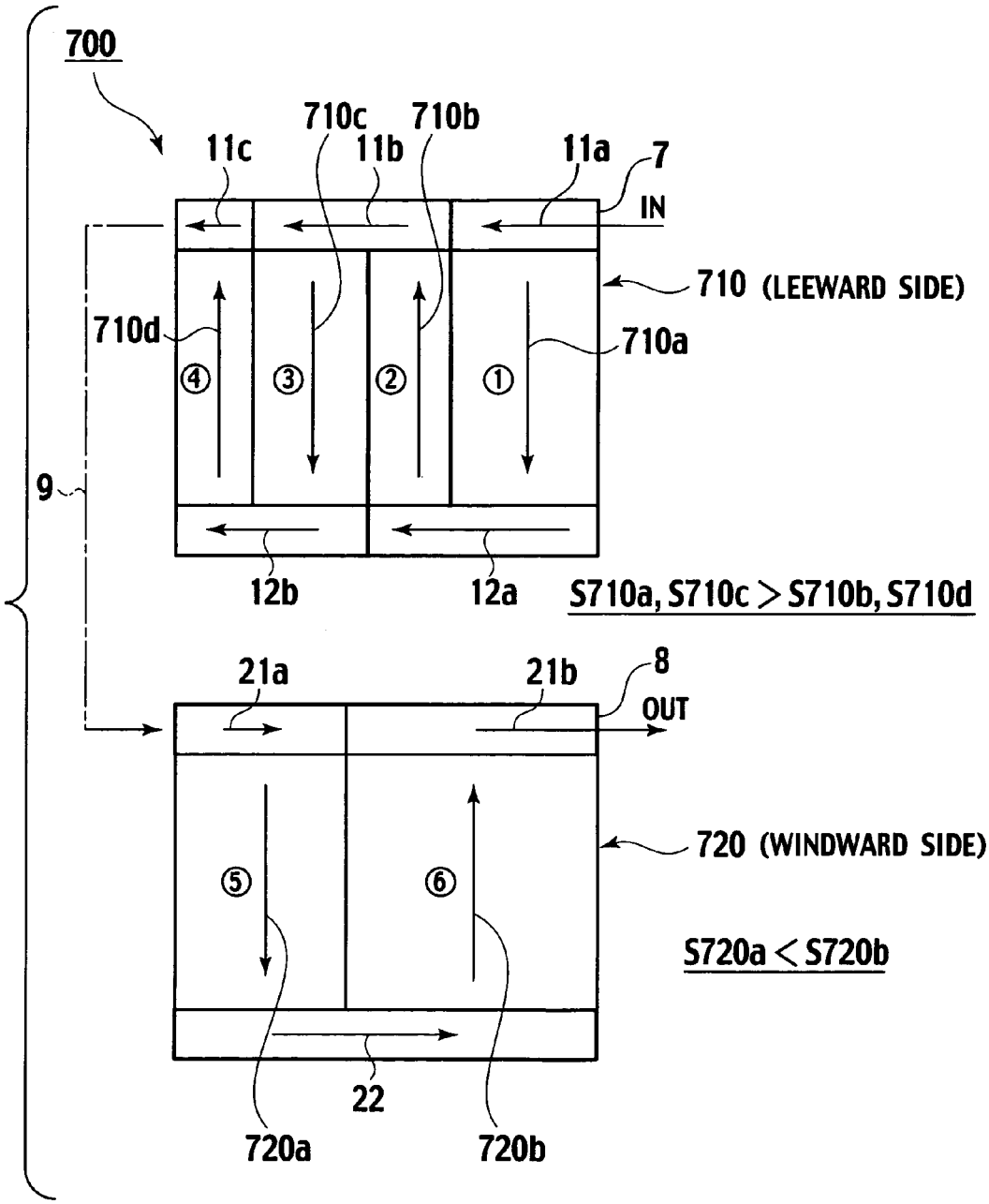
FIG. 15 is a schematic view showing an evaporator in accordance with a seventh embodiment.

Seventh embodiment: FIG. 15 shows a seventh embodiment of the present invention. An evaporator 700 in accordance with the seventh embodiment is same as the evaporator 600 of the sixth embodiment except that the evaporator 700 the seventh embodiment is configured so that an outlet heat exchange unit 720 each have two paths.

The evaporator 700 in the seventh embodiment has the following configuration, an effect (VII) to be described later, as well as the same effects as those in the first embodiment (I), (V) and (VI) except (II), (III) and (IV) can be obtained.

(I) The evaporator 700 in the seventh embodiment is configured so that in an inlet heat exchange unit 710, the number of heat exchange passages in a second path 710*b* and a fourth path 710*d* as ascending flow paths is made smaller than the number of heat exchange passages in a first path 710*a* and a third path 710*c* as descending flow paths (S710*a*, S710*c*>S710*b*, S710*d*), and in an outlet heat exchange unit 720, the number of heat exchange passages in a second path 720*b* as a most downstream path, in which volume of the flowing refrigerant is expanded most, is made larger than the number of heat exchange passages in a first path 720*a* as a path immediately before the most downstream path (S720*b*>S720*a*). For this reason, in the inlet heat exchange unit 710 in which dryness of the refrigerant is low and flow distribution of the refrigerant is liable to cause deviation, a liquid refrigerant flowing in the ascending flow paths 710*b*, 710*d* at the upstream side in the tank longitudinal direction, in which the liquid refrigerant tends to lack, increases, and the region where the liquid refrigerant lacks is reduced. This decreases variations in temperature. In the outlet heat exchange unit 720 in which dryness of the refrigerant is high and flow distribution of the refrigerant is not liable to cause deviation, increase in flow resistance in the most downstream path720*b*, in which volume of the flowing refrigerant is expanded most, is suppressed, thereby that flow resistance in the outlet heat exchange unit 720 can be kept low.

(V) The evaporator 700 in the seventh embodiment is configured so that the inlet heat exchange unit 710 has three or more paths, compared with the configuration with two or less paths (for example, the second embodiment and the third embodiment), the total passage sectional areas S710*a*, S710*b*, S710*c* and S710*d* of the paths 710*a*, 710*b*, 710*c*, and 710*d*, respectively, are reduced. Therefore, variations in temperature distribution in the inlet heat exchange unit 710 can be further reduced.

(VI) The evaporator 700 in the seventh embodiment is configured so that the inlet heat exchange unit 710 is disposed at the leeward side and the outlet heat exchange unit 720 is disposed at the windward side. For this reason, air is firstly cooled in the outlet heat exchange unit 720 disposed at the windward side and then the cooled air is further cooled in the inlet heat exchange unit 710 disposed at the leeward side in lower temperatures. That is, air can be cooled in the outlet heat exchange unit 720 and the inlet heat exchange unit 710 in a phased manner. Therefore, the outlet heat exchange unit 720 at the windward side and the inlet heat exchange unit 710 at the leeward side can be efficiently used without waste and heat exchange efficiency can be further increased.

(VII) The evaporator 700 in the seventh embodiment is configured so that the number of paths in the outlet heat exchange unit 720 (two in this case) is smaller than the number of paths in the inlet heat exchange unit 710 (four in this case). For this reason, in the outlet heat exchange unit 720, the total passage sectional areas S720*a* and S720*b* of the paths 720*a* and 720*b*, respectively, becomes larger. As a result, the evaporator is preferable in the case where it is required to further reduce flow resistance of the outlet heat exchange unit 720.

In summary, according to the present invention, in the inlet heat exchange unit in which dryness of the refrigerant is low and flow distribution of the refrigerant is liable to cause deviation, the number of heat exchange passages in the ascending flow path is made smaller than the number of heat exchange passages in the descending flow path. Accordingly, a liquid refrigerant flowing in the ascending flow path at the upstream side in the tank longitudinal direction, in which the liquid refrigerant tends to lack, increases, and the region where the liquid refrigerant lacks is reduced. This decreases variations in temperature. Further, in the outlet heat exchange unit in which dryness of the refrigerant is high and flow distribution of the refrigerant is not liable to cause deviation, the number of heat exchange passages in the most downstream path, in which volume of the flowing refrigerant is expanded most, is made larger than the number of heat exchange passages in the path immediately before the most downstream path. Accordingly, increase in flow resistance in the most downstream path is suppressed, thereby that flow resistance in the outlet heat exchange unit can be kept low. Therefore, the evaporator with small variations in temperature and with low flow resistance can be realized.

The entire contents of Japanese Patent Application P2004-110286 (filed on Apr. 2, 2004) are incorporated herein by reference.

Although the invention has been described above by reference to certain embodiments of the invention, the invention is not limited to the embodiments described above. Modifications and variations of the embodiments descried above will occur to those skilled in the art, in light of the above teachings. The scope of the invention is defined with reference to the following claims.

What is claimed is:

1. An evaporator comprising first and second heat exchange units each comprising:

a plurality of heat exchange passages extending in the vertical direction, wherein the plurality of heat exchange passages is laminated in multistage in the horizontal direction, and wherein the heat exchange passages have a refrigerant flowing therein; and upper and lower tanks respectively provided at both upper and lower ends of the plurality of heat exchange passages in multistage, wherein the upper and lower tanks join the heat exchange passages in multistage and distribute the refrigerant;

wherein the first and second heat exchange units are arranged in two layers in an air flow direction;

wherein the first and second heat exchange units are connected to each other so that the refrigerant flows through the first heat exchange unit and then through the second heat exchange unit;

wherein the first heat exchange unit, at the inlet side of the evaporator, has at least two flow paths that comprise:

a first descending flow path in which the refrigerant flows from the upper tank of the first heat exchange unit to the lower tank of the first heat exchange unit; and a first ascending flow path in which the refrigerant flows from the lower tank of the first heat exchange unit to the upper tank of the first heat exchange unit;

wherein the second heat exchange unit, at the outlet side of the evaporator, has at least two flow paths that comprise:

a second ascending flow path in which the refrigerant flows from the lower tank of the second heat exchange unit to the upper tank of the second heat change unit; and a second descending flow path in which the refrigerant flows from the upper tank of the second heat exchange unit to the lower tank of the second heat exchange unit;

wherein, in the first heat exchange unit, the number of heat exchange passages in the first ascending path in which the refrigerant ascends is less than the number of heat exchange passages in the first descending path in which the refrigerant descends; and wherein, in the second heat exchange unit, the number of heat exchange passages in a most downstream path is greater than the number of heat exchange passages in a path immediately upstream of the most downstream path.

2. The evaporator according to claim 1, wherein the first and second heat exchange units have the same number of paths; and wherein the refrigerant flows in a path at a windward side and in a path at a leeward side which are opposed to each other in an inverted direction.

3. The evaporator according to claim 1, wherein the number of paths in the second heat exchange unit is less than the number of paths in the first heat exchange unit.

4. The evaporator according to claim 1, wherein the second heat exchange unit has three or more paths; and wherein, in the second heat exchange unit, the number of heat exchange passages gradually increases toward the path at the downstream side.

5. The evaporator according to claim 1, wherein the second heat exchange unit has three or more paths; and wherein, in the second heat exchange unit, the number of heat exchange passages in the second ascending path is less than the number of heat exchange passages in the second descending path except the most downstream path.

6. The evaporator according to claim 1, wherein the first heat exchange unit has three or more paths.

7. The evaporator according to claim 1, wherein the first heat exchange unit is disposed at a leeward side; and wherein the second heat exchange unit is disposed at a windward side.

* * * * *